US009196132B2

(12) United States Patent
Gomez et al.

(10) Patent No.: US 9,196,132 B2
(45) Date of Patent: Nov. 24, 2015

(54) WAGERING GAME HAVING FREE SPIN FEATURE WITH VARIABLE QUANTITIES OF REEL ARRAYS

(71) Applicant: WMS Gaming Inc., Waukegan, IL (US)

(72) Inventors: Benjamin T. Gomez, Chicago, IL (US); Allon G. Englman, Chicago, IL (US); Daniel P. Louie, Chicago, IL (US); Pamela S. Smith, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 14/491,966

(22) Filed: Sep. 19, 2014

(65) Prior Publication Data

US 2015/0011295 A1 Jan. 8, 2015

Related U.S. Application Data

(63) Continuation of application No. 13/801,037, filed on Mar. 13, 2013, now Pat. No. 8,864,571.

(60) Provisional application No. 61/619,717, filed on Apr. 3, 2012.

(51) Int. Cl.
*G07F 17/34* (2006.01)
*G07F 17/32* (2006.01)

(52) U.S. Cl.
CPC ..... *G07F 17/34* (2013.01); *G07F 17/32* (2013.01); *G07F 17/3213* (2013.01); *G07F 17/3267* (2013.01)

(58) Field of Classification Search
CPC ... G07F 17/32; G07F 17/326; G07F 17/3213; G07F 17/3267; G07F 17/34
See application file for complete search history.

(56) References Cited

U.S. PATENT DOCUMENTS 5,890,962 A * 4/1999 Takemoto ..... 463/20
6,015,346 A 1/2000 Bennett ..... 463/20

(Continued)

FOREIGN PATENT DOCUMENTS

AU 2011244929 A1 11/2010 ..... A63F 13/10
WO WO 2004/022181 A2 3/2004

OTHER PUBLICATIONS

PCT International Search Report for International Application No. PCT/US2007/07949 dated Jun. 11, 2008 (2 pages).

(Continued)

*Primary Examiner* — Paul A D'Agostino
*Assistant Examiner* — David Duffy
(74) *Attorney, Agent, or Firm* — Nixon Peabody LLP

(57) ABSTRACT

A gaming system for conducting a wagering game includes at least one input device, at least one display device, at least one processor, and at least one memory device storing instructions. The instructions, when executed by the at least one processor, cause the gaming system to receive a wager for playing the wagering game, and trigger a free-spin event in which a plurality of free spins is awarded. For a first spin, a first number of arrays is randomly determined, displayed, and evaluated to determine whether an award condition is present. For a second spin, a second number of arrays is randomly determined, displayed, and evaluated to determine whether an award condition is present. The second number of arrays is non-equal to the first number of arrays. Any awards associated with each determined award condition are provided.

20 Claims, 7 Drawing Sheets

(56) References Cited

U.S. PATENT DOCUMENTS

| | | | | |
|---|---|---|---|---|
| 6,089,976 | A | 7/2000 | Schneider et al. | 463/16 |
| 6,190,255 | B1 | 2/2001 | Thomas et al. | 463/20 |
| 6,309,300 | B1 | 10/2001 | Glavich | 463/26 |
| 6,328,649 | B1 | 12/2001 | Randall et al. | 463/20 |
| 6,347,996 | B1 | 2/2002 | Gilmore et al. | 463/20 |
| 6,443,452 | B1 | 9/2002 | Brune | 273/143 R |
| 6,471,208 | B2 | 10/2002 | Yoseloff et al. | 273/143 R |
| 6,511,375 | B1 | 1/2003 | Kaminkow | 463/20 |
| 6,514,141 | B1 | 2/2003 | Kaminkow | 463/20 |
| 6,533,273 | B2 | 3/2003 | Cole et al. | 273/138.1 |
| 6,544,120 | B2 * | 4/2003 | Ainsworth | 463/20 |
| 6,561,904 | B2 | 5/2003 | Locke et al. | 463/25 |
| 6,575,830 | B2 | 6/2003 | Baerlocher et al. | 463/20 |
| 6,602,137 | B2 | 8/2003 | Kaminkow et al. | 463/16 |
| 6,634,943 | B1 | 10/2003 | Baerlocher et al. | 463/25 |
| 6,645,073 | B2 | 11/2003 | Lemay et al. | 463/20 |
| 6,648,758 | B2 | 11/2003 | Bennett et al. | 463/20 |
| 6,652,378 | B2 * | 11/2003 | Cannon et al. | 463/20 |
| 6,656,040 | B1 * | 12/2003 | Brosnan et al. | 463/16 |
| 6,659,864 | B2 | 12/2003 | McGahn et al. | 463/16 |
| 6,663,489 | B2 | 12/2003 | Baerlocher et al. | 463/20 |
| 6,726,563 | B1 | 4/2004 | Baerlocher et al. | 463/25 |
| 6,729,618 | B1 | 5/2004 | Koenig et al. | 273/138.2 |
| 6,739,971 | B2 | 5/2004 | Devaull | 463/20 |
| 6,769,982 | B1 * | 8/2004 | Brosnan | 463/16 |
| 6,796,900 | B2 | 9/2004 | Baerlocher | 463/16 |
| 6,796,905 | B2 | 9/2004 | Baerlocher et al. | 463/25 |
| 6,811,483 | B1 | 11/2004 | Webb et al. | 463/16 |
| 6,860,810 | B2 * | 3/2005 | Cannon et al. | 463/20 |
| 6,890,257 | B2 | 5/2005 | Baerlocher | 463/25 |
| 7,108,602 | B2 * | 9/2006 | Daly | 463/20 |
| 7,156,735 | B2 * | 1/2007 | Brosnan et al. | 463/16 |
| 7,354,342 | B2 | 4/2008 | Paulsen et al. | 463/16 |
| 7,354,344 | B2 | 4/2008 | Paulsen et al. | 463/20 |
| 7,390,260 | B2 | 6/2008 | Englman | 463/20 |
| 7,559,840 | B1 | 7/2009 | D'Avanzo | 463/30 |
| 7,566,271 | B2 | 7/2009 | Hostetler et al. | 463/25 |
| 7,611,406 | B2 * | 11/2009 | Fuller | 463/20 |
| 7,625,282 | B2 | 12/2009 | Baerlocher et al. | 463/25 |
| 7,651,392 | B2 | 1/2010 | Pennington et al. | 463/16 |
| 7,713,123 | B2 | 5/2010 | Gerson et al. | 463/25 |
| 7,785,195 | B2 | 8/2010 | Palmer et al. | 463/25 |
| 7,806,764 | B2 * | 10/2010 | Brosnan et al. | 463/20 |
| 7,905,772 | B2 | 3/2011 | Baerlocher et al. | 463/20 |
| 7,959,508 | B2 | 6/2011 | Gauselmann | 463/25 |
| 8,033,910 | B2 | 10/2011 | Davis | 463/25 |
| 8,087,991 | B2 | 1/2012 | D'Avanzo | 463/20 |
| 8,414,372 | B2 * | 4/2013 | Cannon et al. | 463/16 |
| 8,715,070 | B2 * | 5/2014 | Cannon et al. | 463/25 |
| 2001/0046893 | A1 | 11/2001 | Giobbi et al. | 463/24 |
| 2002/0025846 | A1 | 2/2002 | Bennett et al. | 463/20 |
| 2002/0183105 | A1 * | 12/2002 | Cannon et al. | 463/16 |
| 2003/0054872 | A1 | 3/2003 | Locke et al. | 462/20 |
| 2003/0054875 | A1 | 3/2003 | Marks et al. | 463/20 |
| 2003/0069056 | A1 | 4/2003 | Cormack et al. | 463/16 |
| 2003/0162583 | A1 | 8/2003 | Baerlocher et al. | 463/20 |
| 2003/0162585 | A1 | 8/2003 | Bigelow, Jr. et al. | 463/20 |
| 2003/0211879 | A1 | 11/2003 | Englman | 463/20 |
| 2004/0018873 | A1 | 1/2004 | Hughs-Baird et al. | 463/20 |
| 2004/0023707 | A1 | 2/2004 | Maya et al. | 463/16 |
| 2004/0038731 | A1 | 2/2004 | Englman | 463/25 |
| 2004/0053665 | A1 | 3/2004 | Baerlocher | 463/16 |
| 2004/0053672 | A1 | 3/2004 | Baerlocher | 463/20 |
| 2004/0053678 | A1 | 3/2004 | Savio et al. | 463/20 |
| 2004/0053679 | A1 | 3/2004 | Getz et al. | 463/20 |
| 2004/0063493 | A1 | 4/2004 | Baerlocher | 463/25 |
| 2004/0072619 | A1 * | 4/2004 | Brosnan et al. | 463/42 |
| 2004/0106446 | A1 * | 6/2004 | Cannon et al. | 463/16 |
| 2004/0121838 | A1 | 6/2004 | Hughs-Baird et al. | 463/25 |
| 2004/0219962 | A1 | 11/2004 | Vancura | 463/9 |
| 2004/0219967 | A1 | 11/2004 | Giobbi et al. | 463/24 |
| 2004/0242313 | A1 * | 12/2004 | Munoz | 463/20 |
| 2005/0101368 | A1 | 5/2005 | Thomas | 463/16 |
| 2005/0130731 | A1 | 6/2005 | Englman et al. | 463/20 |
| 2005/0130737 | A1 * | 6/2005 | Englman et al. | 463/25 |
| 2005/0233794 | A1 * | 10/2005 | Cannon et al. | 463/16 |
| 2005/0245309 | A1 | 11/2005 | Englman | 463/20 |
| 2006/0025201 | A1 | 2/2006 | Van Asdale et al. | 463/20 |
| 2006/0079313 | A1 | 4/2006 | Trainor et al. | 463/20 |
| 2006/0121978 | A1 | 6/2006 | Hornik et al. | 463/20 |
| 2006/0199634 | A1 | 9/2006 | Anderson et al. | 463/20 |
| 2007/0021183 | A1 | 1/2007 | Fiden et al. | 463/17 |
| 2007/0099688 | A1 * | 5/2007 | Brosnan et al. | 463/16 |
| 2013/0065663 | A1 * | 3/2013 | Johnson et al. | 463/20 |
| 2013/0102375 | A1 * | 4/2013 | Aoki et al. | 463/20 |

OTHER PUBLICATIONS

PCT Written Opinion for International Application No. PCT/US2007/07949 dated Jun. 11, 2008 (2 pages).

"*Secret X*," http://gscentral.net/secretx.htm, retrieved on Jun. 6, 2013 (3 pages).

"*Super Ball*," http://gscentral.net/super.htm, retrieved on Jun. 6, 2013 (4 pages).

"*Master Key*," http://gscentral.net/key.htm, date estimated as early as 1983, retrieved on Jun. 6, 2013 (3 pages).

"*Plinko*," http://gscentral.net/plinko.htm, date estimated as early as 2002, retrieved on Jun. 6, 2013 (8 pages).

* cited by examiner

WAGERING GAME HAVING FREE SPIN FEATURE WITH VARIABLE QUANTITIES OF REEL ARRAYS

CROSS-REFERENCE TO RELATED APPLICATIONS

This application is a continuation of U.S. application Ser. No. 13/801,037, filed Mar. 13, 2013, titled "Wagering Game Having Free Spin Feature With Variable Quantities Of Reel Arrays," and issued as U.S. Pat. No. 8,864,571 on Oct. 21, 2014; which claims the benefit of and priority to U.S. Provisional Patent Application No. 61/619,717, filed on Apr. 3, 2012, and titled "Wagering Game Having Free Spin Feature With Variable Quantities Of Reel Arrays;" each of which is incorporated herein by reference in its respective entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus and methods and, more particularly, to displaying a random number of reel arrays before each wagered reel spin.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

Free spin events typically include a plurality of free spins that are received by a player. When played, each of the free spins shows a reel array with reels in motion that eventually stop to indicate a randomly selected outcome, which is represented using a plurality of symbols. If the symbols are arranged in a winning combination, an award is provided to the player.

SUMMARY OF THE INVENTION

According to one aspect of the present invention, a gaming system for conducting a wagering game includes at least one input device, at least one display device, at least one processor, and at least one memory device storing instructions. The instructions, when executed by the at least one processor, cause the gaming system to receive a wager for playing the wagering game, and trigger a free-spin event in which a plurality of free spins is awarded. For a first spin, a first number of arrays is randomly determined, displayed, and evaluated to determine whether an award condition is present. For a second spin, a second number of arrays is randomly determined, displayed, and evaluated to determine whether an award condition is present. The second number of arrays is non-equal to the first number of arrays. Any awards associated with each determined award condition are provided.

According to another aspect of the invention, a method of conducting a wagering game on a gaming system includes receiving a wager in response to an input via at least one input device. In response to the wager, a play of a wagering game is initiated by at least one of one or more processors, the play being represented in a form of one or more reel arrays. A first number of arrays is randomly determined, by at least one of the one or more processors, for a first spin of the plurality of free spins. The first number of arrays is displayed on at least one display device, and each array is evaluated to determine whether an award condition is present. A second number of arrays is randomly determined, by at least one of the one or more processors, for a second spin of the plurality of free spins. The second number of arrays is non-equal to the first number of arrays. The second number of arrays is displayed on the at least one display device, and each array is evaluated to determine whether an award condition is present. Any awards associated with each determined award condition are provided by at least one of the one or more processors.

According to yet another aspect of the invention, one or more machine-readable non-transitory storage media is encoded with instructions which, when executed by one or more processors, cause the one or more processors to perform operations including receiving a wager for playing a wagering game, and triggering a free-spin event in which a plurality of free spins is awarded, the plurality of free spins including a first spin and a second spin. Prior to evaluating the first spin, a first number of first reel arrays is randomly generated, and the first reel arrays are displayed on at least one display device. Prior to evaluating the second spin, a second number of second reel arrays is randomly generated, and the second reel arrays are displayed on the at least one display device.

Additional aspects of the invention will be apparent to those of ordinary skill in the art in view of the detailed description of various embodiments, which is made with reference to the drawings, a brief description of which is provided below.

Figure 1:
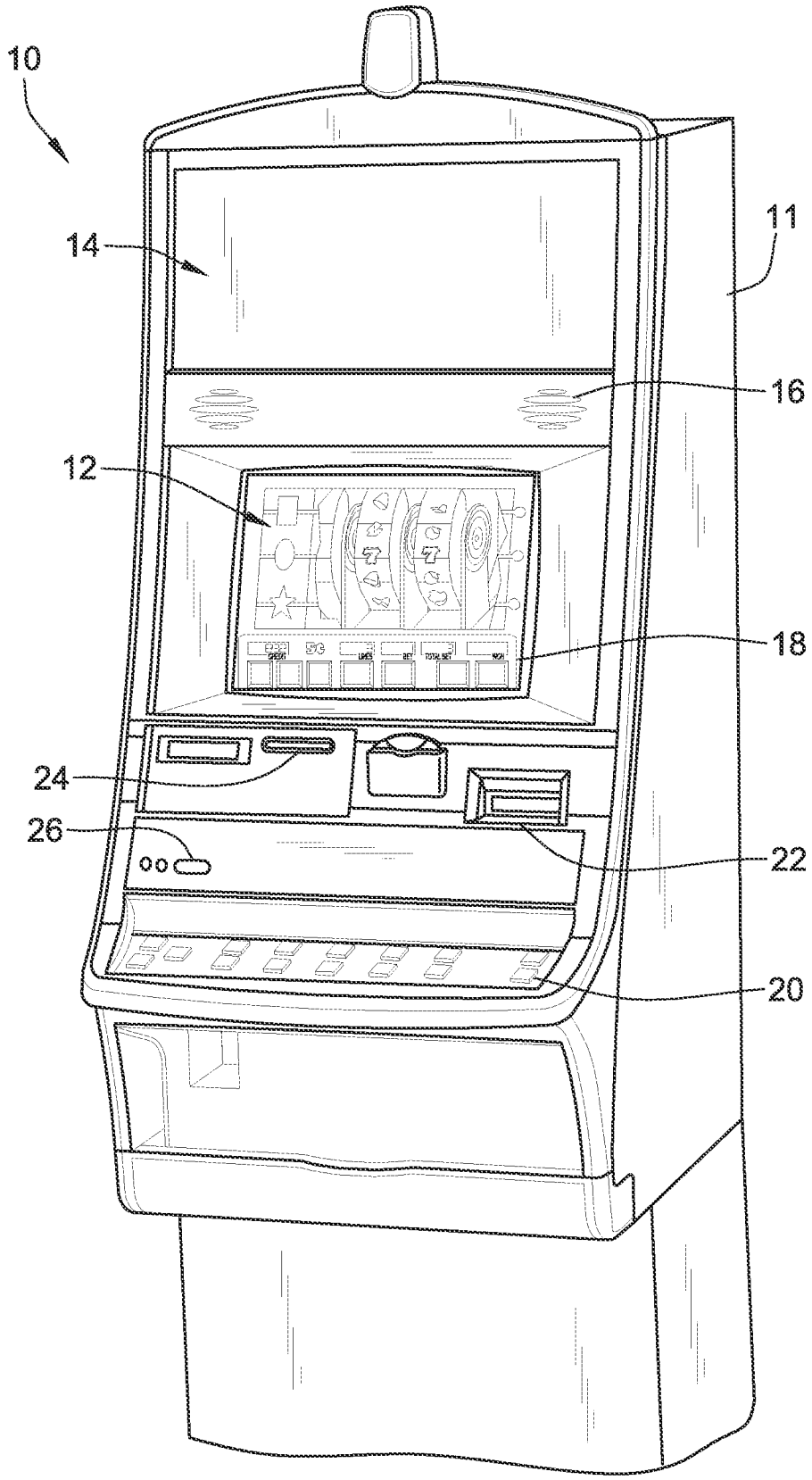
FIG. 1 (PRIOR ART)
FIG. 1 is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

Referring to FIG. 1, there is shown a gaming terminal 10 similar to those used in gaming establishments, such as casinos. With regard to the present invention, the gaming terminal 10 may be any type of gaming terminal and may have varying structures and methods of operation. For example, in some aspects, the gaming terminal 10 is an electromechanical gaming terminal configured to play mechanical slots, whereas in other aspects, the gaming terminal is an electronic gaming terminal configured to play a video casino game, such as slots, keno, poker, blackjack, roulette, craps, etc. The gaming terminal 10 may take any suitable form, such as floor-standing models as shown, handheld mobile units, bartop models, workstation-type console models, etc. Further, the gaming terminal 10 may be primarily dedicated for use in conducting wagering games, or may include non-dedicated devices, such as mobile phones, personal digital assistants, personal computers, etc. Exemplary types of gaming terminals are disclosed in U.S. Pat. No. 6,517,433 and Patent Application Publication Nos. US2010/0062196 and US2010/0234099, which are incorporated herein by reference in their entireties.

The gaming terminal 10 illustrated in FIG. 1 comprises a cabinet 11 that may house various input devices, output devices, and input/output devices. By way of example, the gaming terminal 10 includes a primary display area 12, a secondary display area 14, and one or more audio speakers 16. The primary display area 12 or the secondary display area 14 may be a mechanical-reel display, a video display, or a combination thereof in which a transmissive video display is disposed in front of the mechanical-reel display to portray a video image superimposed upon the mechanical-reel display. The display areas may variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming terminal 10. The gaming terminal 10 includes a touch screen(s) 18 mounted over the primary or secondary areas, buttons 20 on a button panel, bill validator 22, information reader/writer(s) 24, and player-accessible port(s) 26 (e.g., audio output jack for headphones, video headset jack, USB port, wireless transmitter/receiver, etc.). It should be understood that numerous other peripheral devices and other elements exist and are readily utilizable in any number of combinations to create various forms of a gaming terminal in accord with the present concepts.

Input devices, such as the touch screen 18, buttons 20, a mouse, a joystick, a gesture-sensing device, a voice-recognition device, and a virtual input device, accept player input(s) and transform the player input(s) to electronic data signals indicative of the player input(s), which correspond to an enabled feature for such input(s) at a time of activation (e.g., pressing a "Max Bet" button or soft key to indicate a player's desire to place a maximum wager to play the wagering game). The input(s), once transformed into electronic data signals, are output to a CPU for processing. The electronic data signals are selected from a group consisting essentially of an electrical current, an electrical voltage, an electrical charge, an optical signal, an optical element, a magnetic signal, and a magnetic element.

Figure 2:
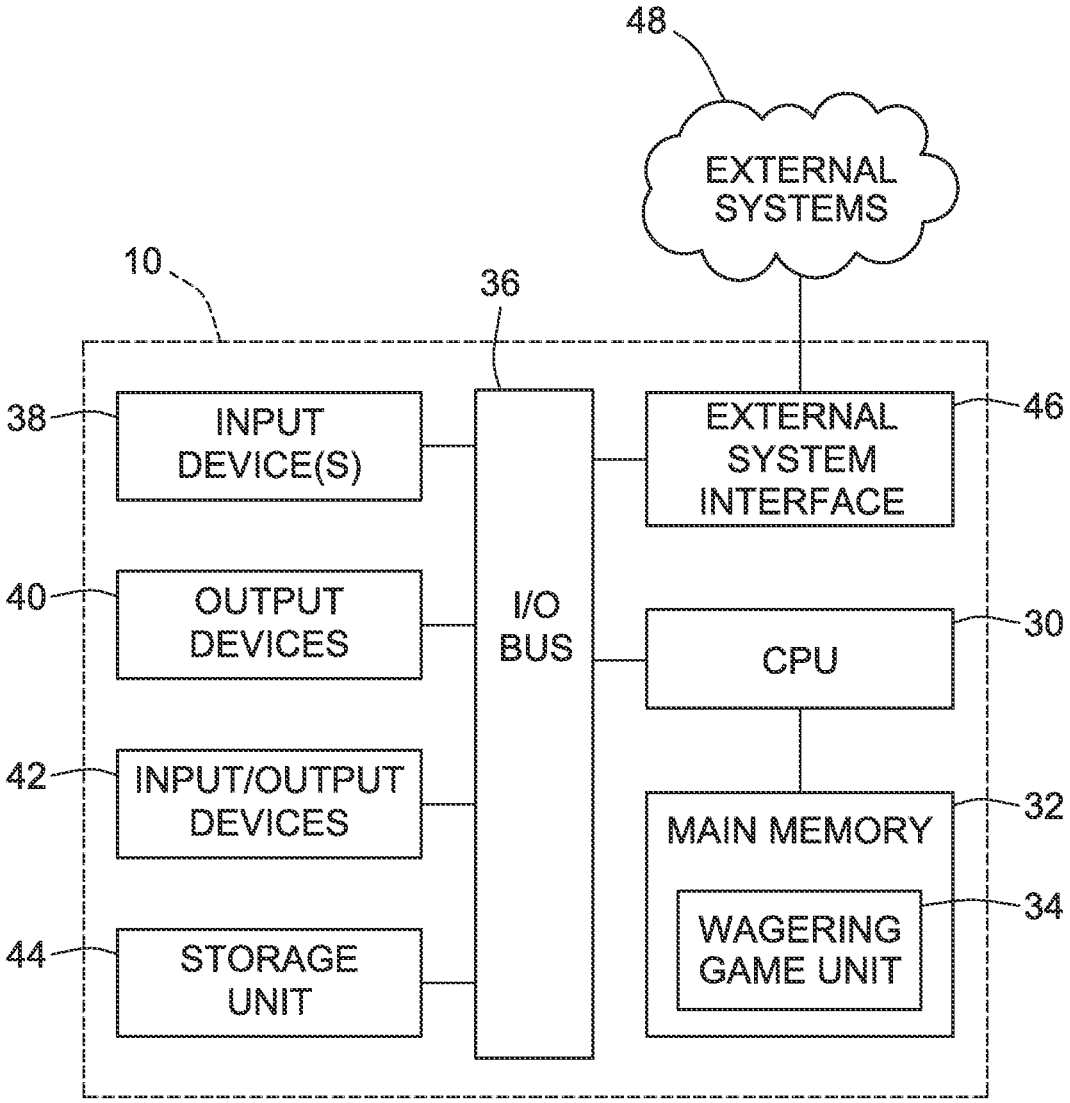
FIG. 2 (PRIOR ART)
FIG. 2 is a schematic view of a gaming system according to an embodiment of the present invention.

Turning now to FIG. 2, there is shown a block diagram of the gaming-terminal architecture. The gaming terminal 10 includes a central processing unit (CPU) 30 connected to a main memory 32. The CPU 30 may include any suitable processor(s), such as those made by Intel and AMD. By way of example, the CPU 30 includes a plurality of microprocessors including a master processor, a slave processor, and a secondary or parallel processor. CPU 30, as used herein, comprises any combination of hardware, software, or firmware disposed in or outside of the gaming terminal 10 that is configured to communicate with or control the transfer of data between the gaming terminal 10 and a bus, another computer, processor, device, service, or network. The CPU 30 comprises one or more controllers or processors and such one or more controllers or processors need not be disposed proximal to one another and may be located in different devices or in different locations. The CPU 30 is operable to execute all of the various gaming methods and other processes disclosed herein. The main memory 32 includes a wagering game unit 34. In one embodiment, the wagering game unit 34 may present wagering games, such as video poker, video black jack, video slots, video lottery, etc., in whole or part.

The CPU 30 is also connected to an input/output (I/O) bus 36, which can include any suitable bus technologies, such as an AGTL+frontside bus and a PCI backside bus. The I/O bus 36 is connected to various input devices 38, output devices 40, and input/output devices 42 such as those discussed above in connection with FIG. 1. The I/O bus 36 is also connected to storage unit 44 and external system interface 46, which is connected to external system(s) 48 (e.g., wagering game networks).

The external system 48 includes, in various aspects, a gaming network, other gaming terminals, a gaming server, a remote controller, communications hardware, or a variety of other interfaced systems or components, in any combination. In yet other aspects, the external system 48 may comprise a player's portable electronic device (e.g., cellular phone, electronic wallet, etc.) and the external system interface 46 is configured to facilitate wireless communication and data transfer between the portable electronic device and the CPU 30, such as by a near-field communication path operating via magnetic-field induction or a frequency-hopping spread spectrum RF signals (e.g., Bluetooth, etc.).

The gaming terminal 10 optionally communicates with the external system 48 such that the terminal operates as a thin, thick, or intermediate client. In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets are contained within the gaming terminal 10 ("thick client" gaming terminal), the external system 48 ("thin client" gaming terminal), or are distributed therebetween in any suitable manner ("intermediate client" gaming terminal).

The gaming terminal 10 may include additional peripheral devices or more than one of each component shown in FIG. 2. Any component of the gaming terminal architecture may include hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic disk storage media, optical storage media, flash memory, etc.

Figure 3:
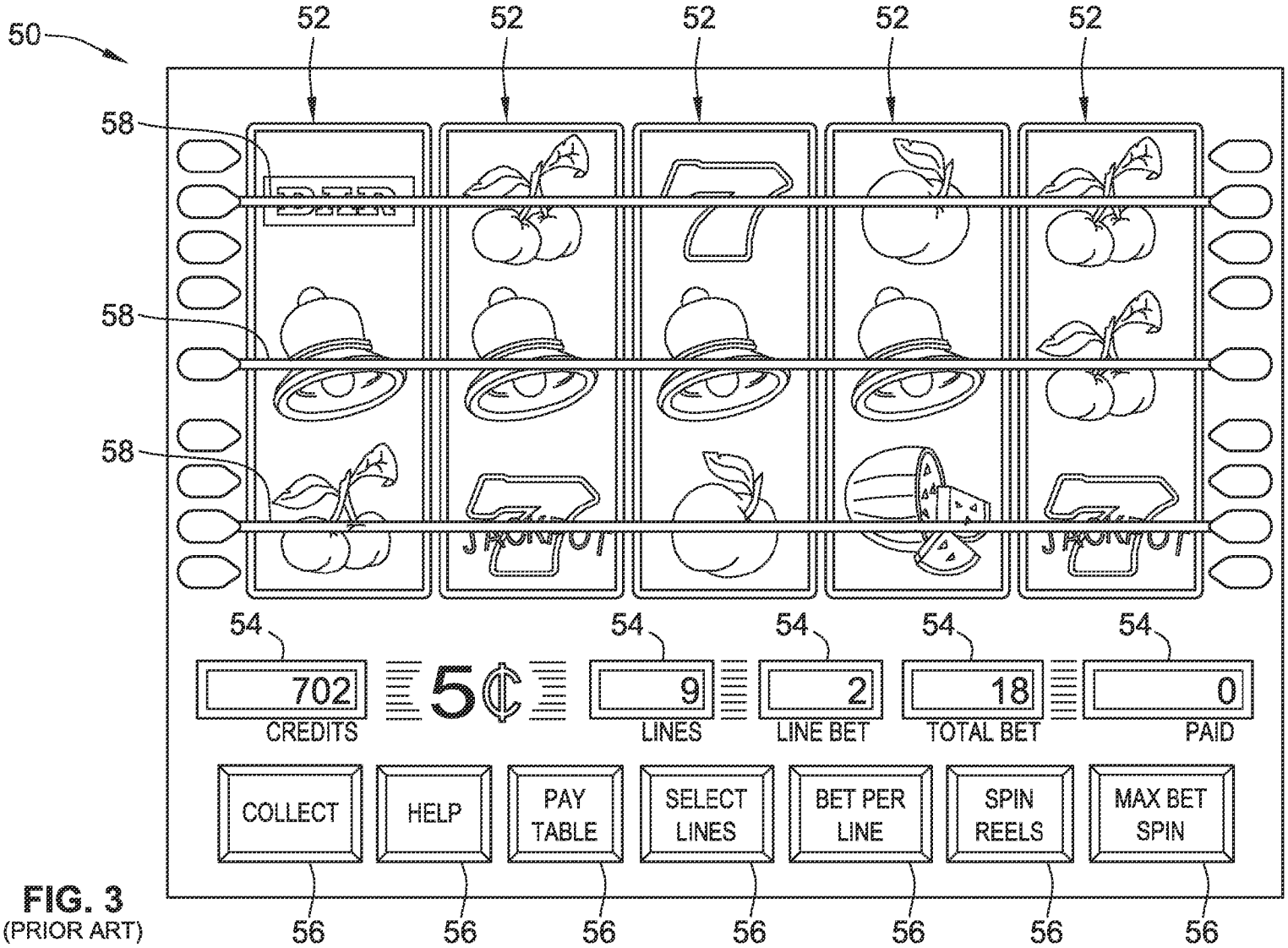
FIG. 3 (PRIOR ART)
FIG. 3 is an image of an exemplary basic-game screen of a wagering game displayed on a gaming terminal, according to an embodiment of the present invention.

Referring now to FIG. 3, there is illustrated an image of a basic-game screen 50 adapted to be displayed on the primary display area 12 or the secondary display area 14. The basic-game screen 50 portrays a plurality of simulated symbol-bearing reels 52. Alternatively or additionally, the basic-game screen 50 portrays a plurality of mechanical reels or other video or mechanical presentation consistent with the game format and theme. The basic-game screen 50 also advantageously displays one or more game-session credit meters 54 and various touch screen buttons 56 adapted to be actuated by a player. A player can operate or interact with the wagering game using these touch screen buttons or other input devices such as the buttons 20 shown in FIG. 1. The CPU operate(s) to execute a wagering game program causing the primary display area 12 or the secondary display area 14 to display the wagering game.

In response to receiving a wager, the reels 52 are rotated and stopped to place symbols on the reels in visual association with paylines such as paylines 58. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering game outcome is provided or displayed in response to the wager being received or detected. The wagering game outcome is then revealed to the player in due course following initiation of the wagering game. The method comprises the acts of conducting the wagering game using a gaming apparatus, such as the gaming terminal 10 depicted in FIG. 1, following receipt of an input from the player to initiate the wagering game. The gaming terminal 10 then communicates the wagering game outcome to the player via one or more output devices (e.g., primary display 12 or secondary display 14) through the display of information such as, but not limited to, text, graphics, static images, moving images, etc., or any combination thereof. In accord with the method of conducting the wagering game, the CPU transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the CPU (e.g., CPU 30) is configured to process the electronic data signal, to interpret the data signal (e.g., data signals corresponding to a wager input), and to cause further actions associated with the interpretation of the signal in accord with computer instructions relating to such further actions executed by the controller. As one example, the CPU causes the recording of a digital representation of the wager in one or more storage media (e.g., storage unit 44), the CPU, in accord with associated computer instructions, causing the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM), etc. The noted second state of the data storage media comprises storage in the storage media of data representing the electronic data signal from the CPU (e.g., the wager in the present example). As another example, the CPU further, in accord with the execution of the instructions relating to the wagering game, causes the primary display 12, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of computer instructions relating to the wagering game is further conducted in accord with a random outcome (e.g., determined by a RNG) that is used by the CPU to determine the outcome of the game sequence, using a game logic for determining the outcome based on the randomly generated number. In at least some aspects, the CPU is configured to determine an outcome of the game sequence at least partially in response to the random parameter.

Figure 4:
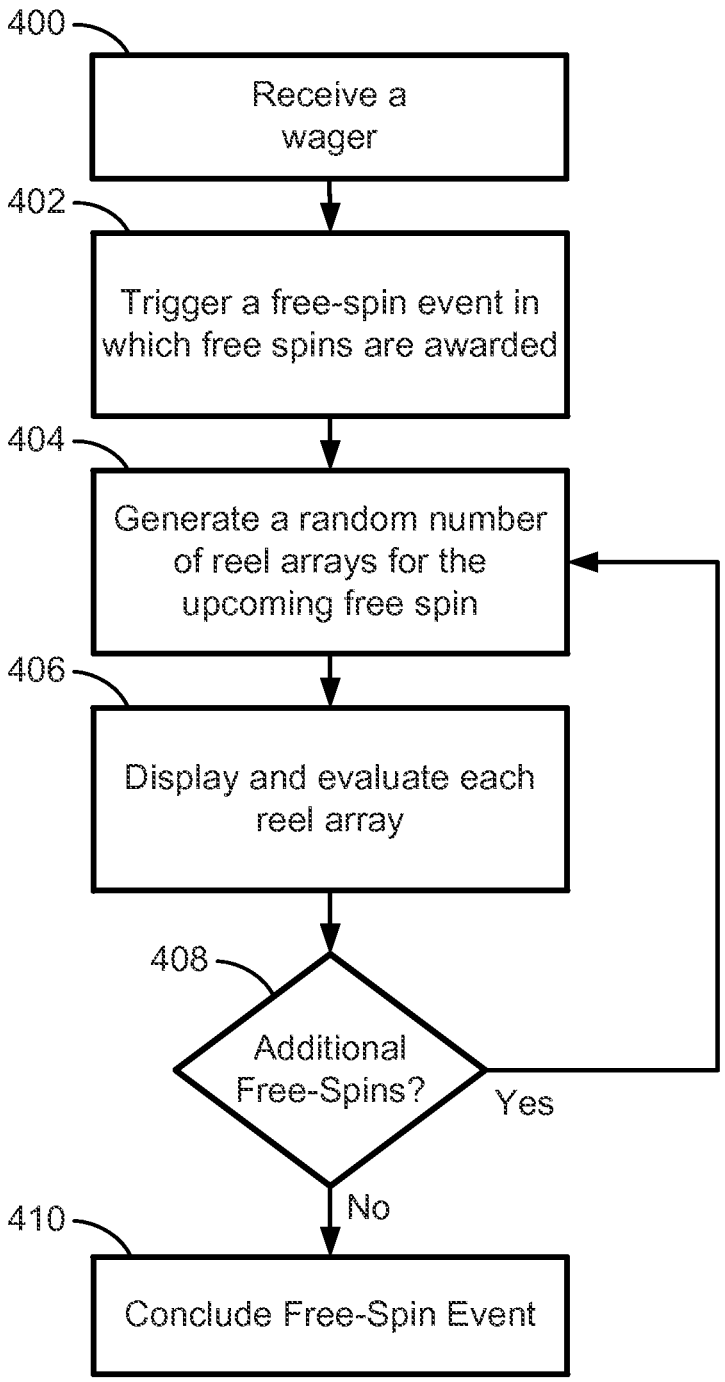
FIG. 4 is a flowchart for an algorithm that corresponds to instructions executed by a controller in accordance with at least some aspects of the disclosed concepts.

Referring now to FIG. 4, a method for conducting a wagering game is directed generally to a random selection of variable quantities of reel arrays. The random selection refers to generating a random number of reel arrays before every wagered spin, every spin in a series of free spins, or any other game-play mechanic where randomly generated outcomes are displayed utilizing one or more reel array. As such, the random selection of a number of reel arrays may be presented in either or both of a base game and a bonus game of the wagering game. As described below, in one example the bonus game is a free-spin event.

According to one example, a wager is received from a player at step 400. After receiving the wager, a free-spin event is triggered at step 402. The free-spin event is an event in which free spins are awarded. For example, the free-spin event may award five free spins to the player. The free-spin event can be triggered, for example, while conducting a base game or a bonus game of the wagering game.

At step 404, prior to evaluation of each one of the awarded free spins, a random number of reel arrays is generated for each of the free spins. For example, on a first free spin, the player may receive three reel arrays, on a second free spin the player may receive a single reel array, on a third free spin the player may receive eight reel arrays, etc. According to this example, the number of arrays for one of the free spins is non-equal to the number of arrays for another free spin, e.g., the first free spin had three arrays but the second free spin had one array.

Optionally, the random generation of reel arrays can include a reel feature in which a player pick prior to each free spin provides enhancements to the reel arrays. For example, a player pick may provide one or more enhancements in the form of multipliers, scatter pays, wild reels, expanding reels, random wild symbols, extra wild symbols, etc. The enhancements can be any enhancing feature that potentially enhances a randomly selected outcome of the wagering game.

In one example, the wild enhancement generally refers to providing a wild symbol that is different from and that can be used to replace any of the symbols required for a winning combination. The wild symbol can be a randomly generated symbol or a predetermined symbol. Thus, the wild enhancement potentially increase the likelihood (or perceived likelihood) of receiving a winning symbol combination.

In accordance with some embodiments, the enhancements may be dependent on the number of reel arrays provided. For example, if a three-wild-reels enhancement is selected, a likelihood of receiving a large number of reel arrays is less than if a one-wild-reel enhancement is selected. Thus, in this example, the provided enhancements are inversely proportional to the number of reel arrays, i.e., a good enhancement will be associated with a larger number of reel arrays, but a better (or great) enhancement will be associated with a smaller number of reel arrays, in general, and/or will, on the average, yield more valuable award conditions than the good enhancement. However, regardless of this type of dependency between the enhancements and the number of reel arrays (in which the probability of receiving a specific number of reel arrays varies), the number of arrays is still randomly determined from spin to spin.

After generating the random number of reel arrays at step 404, each of the reel arrays is displayed and evaluated at step 406. If the evaluation determines that an award condition is present, any awards associated with the determined award condition are provided to the player. Typically, in accordance with one embodiment, the reel arrays are displayed and evaluated generally simultaneously. After evaluating the reel arrays, a determination is made, at decision box 408, on whether additional free spins remain. If the determination is that additional free spins remain, steps 404, 406, and 408 are repeated until the determination is made that no additional free spins remain, at which point the free-spin event is concluded as step 410.

Optionally, instead of a free-spin event, the random selection of reel arrays can occur before every wagered spin (or play) in a base game or in a bonus game. Thus, for example, if a player provides a wager for a reel spin, the player may receive, randomly, one or more reel arrays that are simultaneously displayed. The player is not necessarily aware of the random determination of the number of reel arrays. As such, if the player is unaware, the player is likely to be pleasantly surprised when a plurality of reel arrays (instead of a typical single reel array) are displayed on a screen. Further, by performing the random determination after the wager has been received, a player is prevented from exploiting the feature and increasing their wager when a larger number of arrays are to be received. It should be noted, however, that allowing the player to attempt to exploit the feature may also be a desirable characteristic and, in certain embodiments, may be specifically designed to allow for.

Optionally yet, a guarantee start-value of the reel arrays is dependent on the type of game in which the reel arrays are presented. For example, if the reel arrays are presented in a free-spin bonus event, the number of reel arrays that are awarded have a higher guarantee start-value than reel arrays awarded in a base game.

Figure 5:
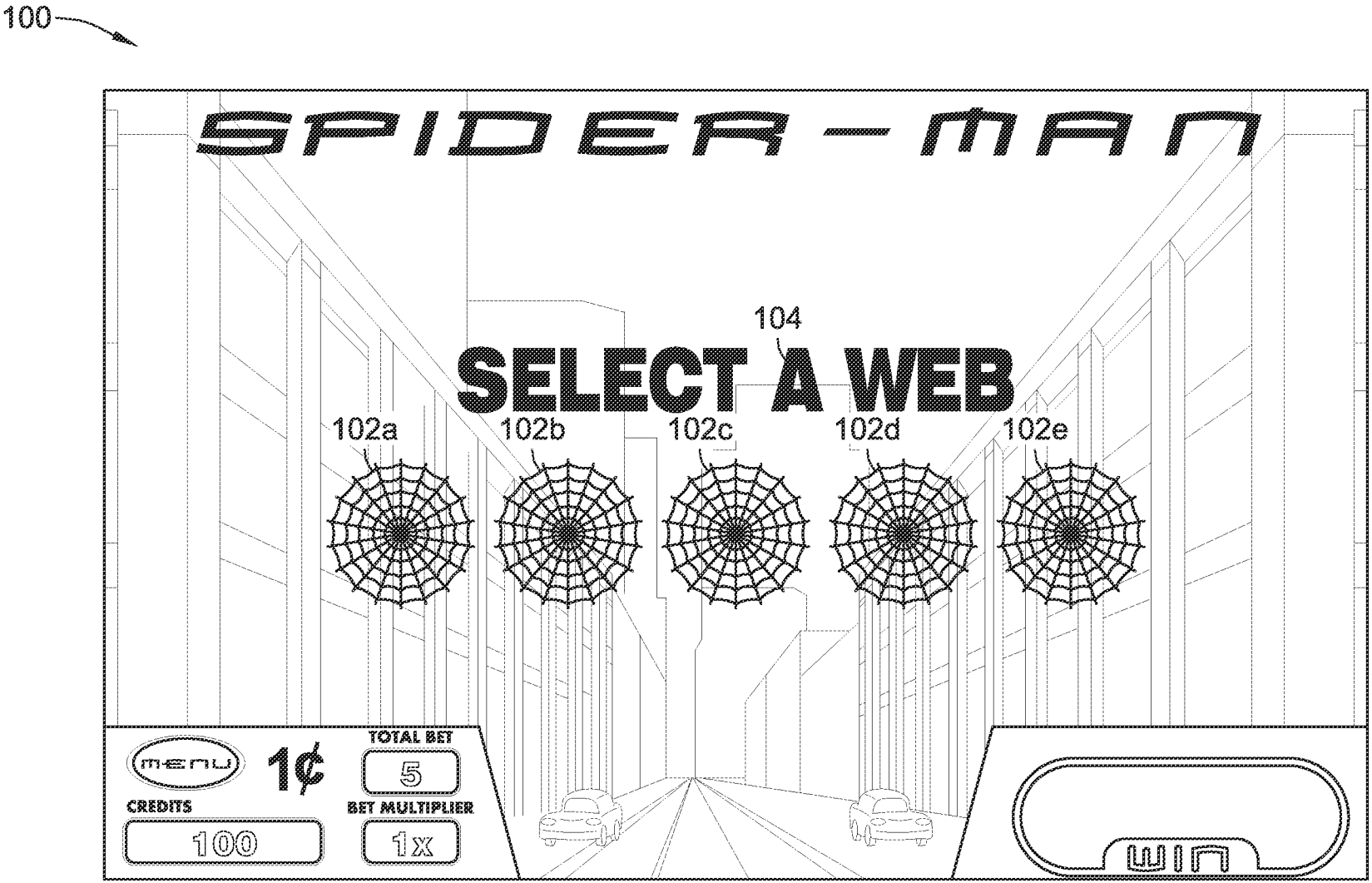
FIG. 5 is selection screen of a wagering game with mystery symbols.

Referring to FIG. 5, a selection screen 100 is adapted to be displayed on the primary display area 12 or the secondary display area 14. The selection screen 100 portrays a plurality of mystery symbols 102*a*-102*e*, which is displayed in the form of spider webs. The player is prompted by a notification 104 to select one or more of the mystery symbols 102*a*-102*e*.

Figure 6:
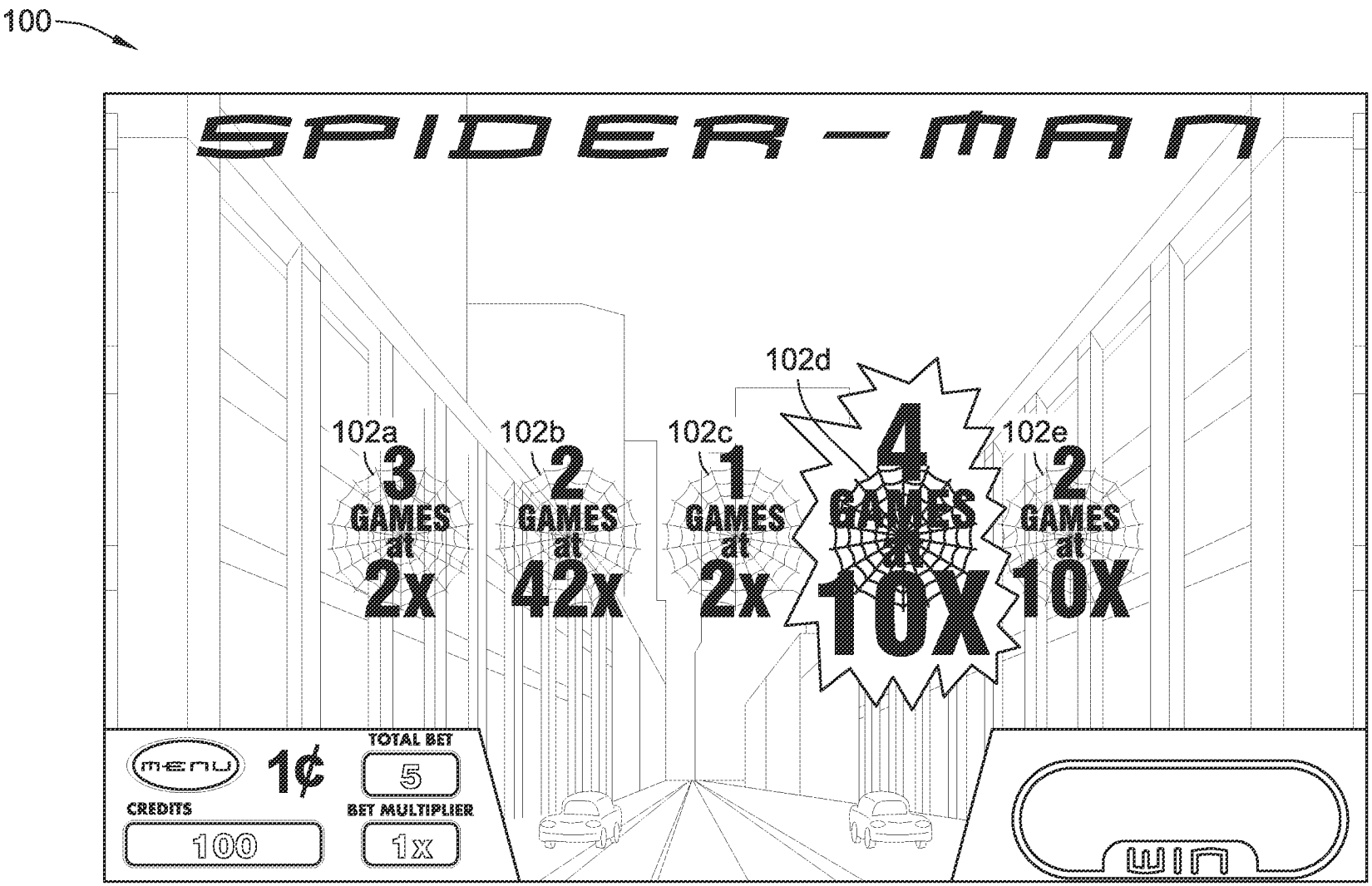
FIG. 6 is the selection screen showing revealed selections.

Referring to FIG. 6, the player has selected a fourth mystery symbol 102*d* of the five mystery symbols 102*a*-102*e*. Upon selection, the fourth mystery symbol 102*d* reveals that the player has been awarded four games (or reel arrays) with a game-enhancement in the form of a 10× multiplier. Optionally, the games and associated game-enhancements of the unselected mystery symbols 102*a*-102*c* and 102*e* are revealed to the player after receiving the player selection. In the illustrated embodiment, the player has received one of the highest awards, i.e., the largest number of games and the next-highest multiplier.

According to other embodiments, the selection screen 100 is omitted to remove the player selection feature from the wagering game. If the selection screen 100 is omitted, a notification similar to the revealed fourth mystery symbol 102*d* is displayed to the player to make him or her aware of the random determination of the number of reel arrays. Or, alternatively, without any notifications after receipt of the corresponding wager, the wagering game displays to the player the free-spin screen 110 that is described in more detail below.

Figure 7:
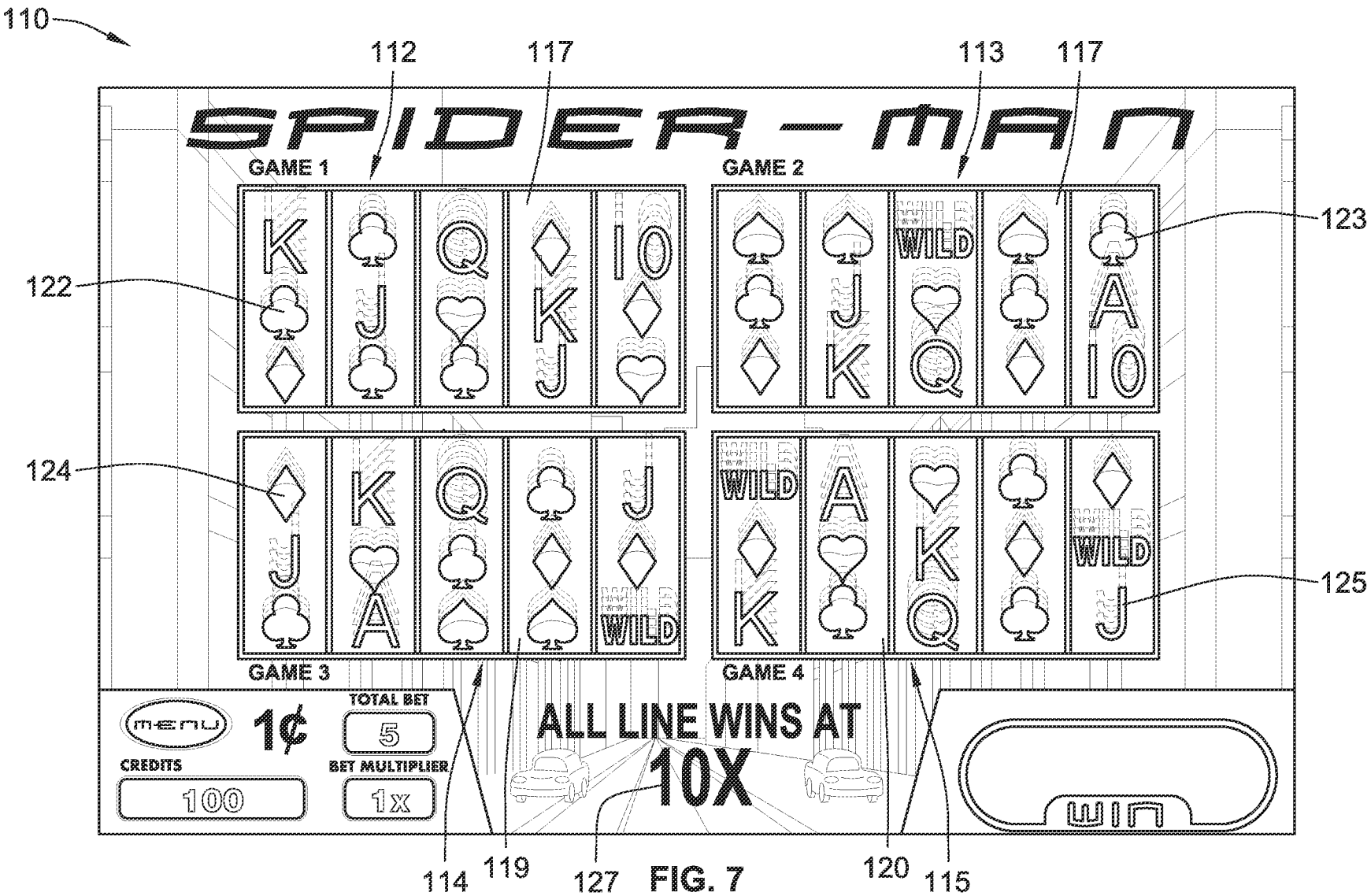
FIG. 7 is a reel-array screen showing a number of spinning reel arrays.

Referring to FIG. 7, a free-spin screen 110 is adapted to be displayed on the primary display area 12 or the secondary display area 14. The free-spin screen 110 portrays four games 112-115 (Games 1-4), each game being a distinct reel array. In other words, each reel array has its own set of reels 117-120.

In this example, each reel array is generally identical to the other ones of the reel arrays 112-115. For example, a first reel array 112 has the same number of reels (e.g., five reels 117-120), the same number of symbols (e.g., three symbols 122-125 per reel), and the same type of symbols (e.g., Poker symbols), as a second reel array 113. However, the reel arrays 112-115 can function and/or perform differently, e.g., can have different configurations. For example, the reel arrays 112-115 can have variable number of reels, symbol sets, reel weightings, payline counts, array forms, etc.

The individual outcomes of each reel array 112-115 (illustrated upon stopping of the reels) are likely, although not necessarily, different from each other. Also, each outcome of the reel arrays 112-115 is multiplied by a 10× multiplier, as indicated by the "All Line Wins At 10×" notification 127.

Optionally, the reel arrays 112-115 are displayed on the screen with all the reels 117-120 spinning generally simultaneously. However, the reels 117-120 can be displayed in different time sequences. For example, the reels 117-120 can be displayed in a sequential spinning motion in which the reels 117 of the first reel array 112 start spinning first, the reels 118 of the second reel array 113 start spinning second, and so on.

The reel arrays 112-115 are displayed instantly on the screen or are displayed using one or more display effects. For example, the display effects include a fading effect, in which the reel arrays 112-115 progressively increase in size, or a real-time three-dimensional effect that utilizes movement and dimension within a modeled environment.

In one embodiment of the present invention, rather than or in addition to selecting the number of arrays for display and evaluation, the configuration of the individual arrays can be randomly determined prior to each spin. For example, whereas a typical wagering game has a predetermined configuration that a player wagers on with every consecutive spin (e.g., FIG. 3's 3-row, 5-column array remains a 3×5 array for every single play of that wagering game), the present invention may be utilized to randomly select and alter the array configuration from spin to spin. In one example, assuming a player was wagering five credits for every base game spin, in the first instance a 3×5 array may be displayed and evaluated for the wager. When another wager is received, a 3×3 array may be displayed and evaluated for that same five-credit amount. When yet another wager is received, a 4×5 array may be displayed and evaluated for that same five-credit amount. When a subsequent wager is received, another 3×5 array may be displayed and evaluated. When an additional wager is received, a 6×3 array may be displayed and evaluated. Thus, although the player wagered five credits with every spin, their base game arrays were very different—and were randomly determined to be the 3×5 array, then the 3×3, the 4×5, another 3×5, and finally a 6×3. In this particular embodiment, the player is provided an additional layer of anticipation from prior art games because prior to the reels spinning and being evaluated (the only anticipation in prior art games), the player is also awaiting and hoping for a highly beneficial array configuration to be selected.

Each of these embodiments and obvious variations thereof is contemplated as falling within the spirit and scope of the claimed invention, which is set forth in the following claims.

What is claimed is:

1. A gaming system, comprising:

a gaming machine primarily dedicated to playing at least one casino wagering game, the gaming machine including a gaming cabinet, an electronic display device, and one or more electronic input devices, the electronic display device and the one or more electronic input devices being coupled to the gaming cabinet, at least one of the one or more electronic input devices configured to accept a physical item associated with a monetary value that establishes a credit balance, at least one of the one or more electronic input devices configured to receive a cashout input that initiates a payout from the credit balance; and one or more controllers configured to:

initiate the casino wagering game in response to a wager input, the wager input decreasing the credit balance, randomly determine a first number of symbol arrays for a first spin of a plurality of spins, the random determination being independent of any symbols resulting from the first spin, each symbol array of the first number of symbol arrays having a plurality of reels and its own independent outcome, direct the electronic display device to display the first number of symbol arrays, evaluate each of the first number of symbol arrays to determine whether an award condition is present, randomly determine a second number of symbol arrays for a second spin of the plurality of spins, the second number of symbol arrays being non-equal to the first number of symbol arrays, the random determination being independent of any symbols resulting from the second spin, each symbol array of the second number of symbol arrays having a plurality of reels and its own independent outcome, direct the electronic display device to display the second number of symbol arrays, evaluate each of the second number of symbol arrays to determine whether an award condition is present, and provide any awards associated with each determined award condition, the awards increasing the credit balance.

2. The gaming system of claim 1, further including a random element generator configured to generate one or more random elements, each independent outcome being randomly selected based, at least in part, on the one or more random elements.

3. The gaming system of claim 2, wherein the random element generator and the one or more controllers reside within the gaming cabinet.

4. The gaming system of claim 1, wherein each of the symbol arrays in the first number of symbol arrays is of a same first configuration and each of the symbol arrays in the second number of symbol arrays is of a same second configuration.

5. The gaming system of claim 1, wherein at least one symbol array of each of the first and second number of symbol arrays have at least one variable feature selected from a group consisting of variable symbol sets, variable reel weightings, variable line counts, and variable array forms.

6. The gaming system of claim 1, wherein the random determination for the first number of symbol arrays is determined by a first selection of a mystery symbol and the random determination for the second number of symbol arrays is determined by a second selection of a mystery symbol.

7. The gaming system of claim 1, wherein the controllers are further configured to associate at least one game enhancement with each of the first number of symbol arrays, the game enhancement being capable of enhancing an outcome for each associated symbol array of the first number of symbol arrays.

8. The gaming system of claim 7, wherein the at least one game enhancement is the same game enhancement for each symbol array of the first number of symbol arrays.

9. The gaming system of claim 7, wherein the controllers are further configured to select the at least one game enhancement from a plurality of potential game enhancements and the random determination for the first number of symbol arrays is impacted by which of the plurality of potential game enhancements is selected.

10. The gaming system of claim 9, wherein the controllers are further configured to select the first number of symbol arrays from a group of numbers including a large number and a small number, the at least one game enhancement being selected from a plurality of potential game enhancements, the plurality of game enhancements including a great enhancement and a good enhancement, the great enhancement, on average, yielding more valuable award conditions than the good enhancement.

11. The gaming system of claim 10, wherein a probability of selecting the large number is larger if the at least one game enhancement is selected to be the good enhancement than if the at least one game enhancement is selected to be the great enhancement.

12. The gaming system of claim 1, wherein the controllers are further configured to direct the electronic display device to display the symbol arrays generally simultaneously.

13. A casino gaming machine primarily dedicated to playing at least one casino wagering game, comprising:

a gaming cabinet;

an electronic display device coupled to the gaming cabinet;

one or more electronic input devices coupled to the gaming cabinet, at least one of the one or more electronic input devices configured to accept a physical item associated with a monetary value that establishes a credit balance, at least one of the one or more electronic input devices configured to receive a cashout input that initiates a payout from the credit balance; and one or more controllers disposed within the gaming cabinet and configured to:

initiate the casino wagering game in response to a wager input, the wager input decreasing the credit balance, randomly determine a first number of symbol arrays for a first spin of a plurality of spins, the random determination being independent of any symbols resulting from the first spin, each symbol array of the first number of symbol arrays having a plurality of reels and its own independent outcome, direct the electronic display device to display the first number of symbol arrays, evaluate each of the first number of symbol arrays to determine whether an award condition is present, randomly determine a second number of symbol arrays for a second spin of the plurality of spins, the second number of symbol arrays being non-equal to the first number of symbol arrays, the random determination being independent of any symbols resulting from the second spin, each symbol array of the second number of symbol arrays having a plurality of reels and its own independent outcome, direct the electronic display device to display the second number of symbol arrays, evaluate each of the second number of symbol arrays to determine whether an award condition is present, and provide any awards associated with each determined award condition, the awards increasing the credit balance.

14. The gaming machine of claim 13, further including a random element generator configured to generate one or more random elements, each independent outcome being randomly selected based, at least in part, on the one or more random elements.

15. The gaming machine of claim 13, wherein each of the symbol arrays in the first number of symbol arrays is of a same first configuration and each of the symbol arrays in the second number of symbol arrays is of a same second configuration.

16. A method of operating a gaming system, the gaming system including one or more controllers and a gaming machine, the gaming machine primarily dedicated to playing at least one casino wagering game, the gaming machine including a gaming cabinet, an electronic display device, and one or more electronic input devices, the electronic display device and the one or more electronic input devices being coupled to the gaming cabinet, the method comprising:

accepting, via at least one of the one or more electronic input devices, a physical item associated with a monetary value;

initiating the casino wagering game in response to a wager input, the wager input decreasing the credit balance;

randomly determining, by the one or more controllers, a first number of reel arrays for a first spin of a plurality of spins, the random determination being independent of any outcome resulting from the first spin, each reel array of the first number of reel arrays having a plurality of reels and its own independent outcome;

displaying the first number of reel arrays on the electronic display device;

evaluating, by the one or more controllers, each of the first number of reel arrays to determine whether an award condition is present;

randomly determining, by the one or more controllers, a second number of reel arrays for a second spin of the plurality of spins, the second number of reel arrays being non-equal to the first number of reel arrays, the random determination being independent of any outcome resulting from the second spin, each reel array of the second number of reel arrays having a plurality of reels and its own independent outcome;

displaying the second number of reel arrays on the electronic display device;

evaluating, by the one or more controllers, each of the second number of reel arrays to determine whether an award condition is present;

awarding, by the one or more controllers, any awards in response to meeting respective determined award conditions, the awards increasing the credit balance; and receiving, via at least one of the one or more electronic input devices, a cashout input that initiates a payout from the credit.

17. The method of claim 16, wherein the random determination for the first number of reel arrays is determined by a first selection of a mystery symbol and the random determination for the second number of reel arrays is determined by a second selection of a mystery symbol.

18. The method of claim 16, further comprising associating, by the one or more controllers, at least one game enhancement with each of the first number of reel arrays, the game enhancement being capable of enhancing an outcome for each associated reel array of the first number of reel arrays.

19. The method of claim 18, wherein the at least one game enhancement is the same game enhancement for each reel array of the first number of reel arrays.

20. The method of claim 16, wherein the first number of reel arrays is selected from a group of numbers including a large number and a small number, at least one game enhancement being selected from a plurality of potential game enhancements, a probability of selecting the large number being larger if the at least one game enhancement is selected to be a good enhancement than if the at least one game enhancement is selected to be a great enhancement, the great enhancement, on average, yielding more valuable award conditions than the good enhancement.

* * * * *